US008783045B2

(12) United States Patent
Xu et al.

(10) Patent No.: US 8,783,045 B2
(45) Date of Patent: Jul. 22, 2014

(54) REDUCED INPUT POWER CRYOGENIC REFRIGERATOR

(75) Inventors: Mingyao Xu, Tokorozawa (JP); Jin Lin Gao, Shanghai (CN)

(73) Assignees: Sumitomo Heavy Industries, Ltd., Tokyo (JP); Shi-APD Cryogenics, Inc., Allentown, PA (US)

( * ) Notice: Subject to any disclaimer, the term of this patent is extended or adjusted under 35 U.S.C. 154(b) by 967 days.

(21) Appl. No.: 11/721,513

(22) PCT Filed: Jan. 13, 2005

(86) PCT No.: PCT/US2005/001102

§ 371 (c)(1),
(2), (4) Date: Jun. 12, 2007

(87) PCT Pub. No.: WO2006/075982

PCT Pub. Date: Jul. 20, 2006

(65) Prior Publication Data

US 2008/0092588 A1 Apr. 24, 2008

(51) Int. Cl.
*F25B 9/00* (2006.01)

(52) U.S. Cl.
USPC ..... 62/6; 62/600

(58) Field of Classification Search
USPC ..... 62/6, 62, 467
See application file for complete search history.

(56) References Cited

U.S. PATENT DOCUMENTS 3,237,421 A 3/1966 Gifford
4,543,793 A * 10/1985 Chellis et al. ..... 62/6
5,295,355 A 3/1994 Zhou et al.
5,522,223 A * 6/1996 Yanai et al. ..... 62/6
5,642,623 A * 7/1997 Hiresaki et al. ..... 62/6
5,720,172 A * 2/1998 Ishizaki ..... 62/6
5,904,046 A * 5/1999 Kawano ..... 62/6
5,927,081 A * 7/1999 Li ..... 62/6
6,094,921 A * 8/2000 Zhu et al. ..... 62/6
6,112,527 A * 9/2000 Steinmeyer et al. ..... 62/6
6,256,998 B1 * 7/2001 Gao ..... 62/6
6,378,312 B1 * 4/2002 Wang ..... 62/6
6,434,947 B2 * 8/2002 Zhu et al. ..... 62/6

(Continued)

FOREIGN PATENT DOCUMENTS

JP 05118683 A * 5/1993
JP 9-4936 1/1997

(Continued)

OTHER PUBLICATIONS

International Search Report and Written Opinion dated Apr. 29, 2005 from the corresponding PCT/US2005/001102 in English.

(Continued)

*Primary Examiner* — Marc Norman
*Assistant Examiner* — Devon Russell
(74) *Attorney, Agent, or Firm* — Katten Muchin Rosenman LLP

(57) ABSTRACT

The present invention relates to valved cryogenic refrigerators, in particular, Gifford McMahon (GM) refrigerators, and GM type pulse tube refrigerators where gas is cycled between high and low pressures by a valve mechanism that connects to an expander. Input power is reduced by use of a buffer volume which stores gas that flows to and from the warm end of the regenerator through a valve that opens and closes during the periods when the main supply and return valves are closed and is closed when the main supply and return valves are open.

8 Claims, 12 Drawing Sheets

(56) References Cited

U.S. PATENT DOCUMENTS

| | | | | |
|---|---|---|---|---|
| 6,536,218 | B1 * | 3/2003 | Steinmeyer | 62/6 |
| 7,062,922 | B1 * | 6/2006 | Kirkconnell et al. | 62/6 |
| 7,509,814 | B2 * | 3/2009 | Xu | 62/6 |
| 7,568,351 | B2 * | 8/2009 | Xu et al. | 62/6 |
| 2004/0168445 | A1 * | 9/2004 | Kunitani et al. | 62/6 |
| 2005/0000232 | A1 * | 1/2005 | Longsworth | 62/6 |
| 2005/0050904 | A1 * | 3/2005 | Suzuki et al. | 62/6 |
| 2011/0100022 | A1 * | 5/2011 | Yuan et al. | 62/6 |

FOREIGN PATENT DOCUMENTS

| | | | |
|---|---|---|---|
| JP | 10-232057 | | 9/1998 |
| JP | 11-063698 | | 3/1999 |
| JP | 2000-18741 | | 1/2000 |
| JP | 2001-241794 | | 9/2001 |
| JP | 2001-280726 | | 10/2001 |
| JP | 2001317827 | | 11/2001 |
| JP | 2001317827 | A * | 11/2001 |

OTHER PUBLICATIONS

International Preliminary Report on Patentability dated Jul. 17, 2007 from the corresponding PCT/US2005/001102.

Japanese Office Action dated Jan. 17, 2012, from corresponding Japanese Application No. 2007-551233.

* cited by examiner

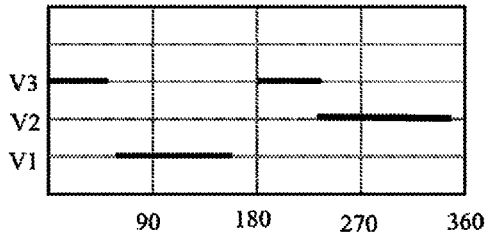
Fig. 17 Valve timing for Fig. 1 to 7
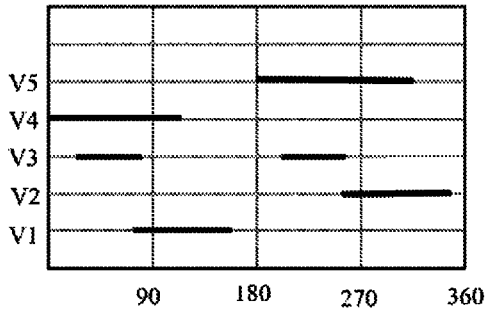
Fig. 18 Valve timing for Fig. 8 to 10
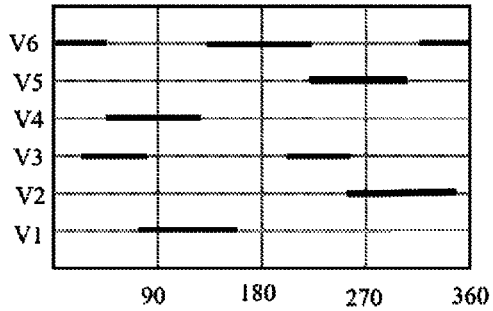
Fig. 19 Valve timing for Fig. 11 to 12

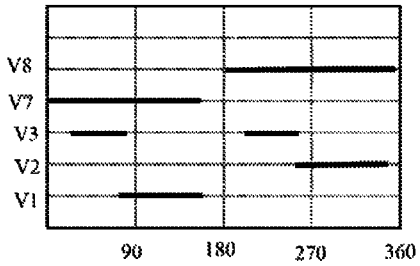
Fig. 20 Valve timing for Fig. 13
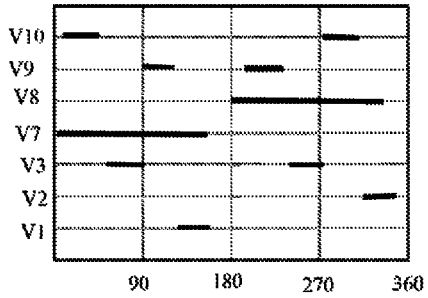
Fig. 21 Valve timing for Fig. 14
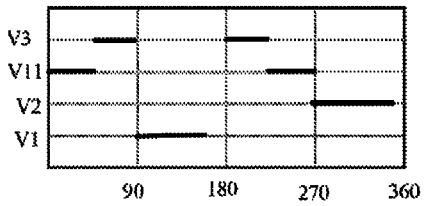
Fig. 22 Valve timing for Fig. 15
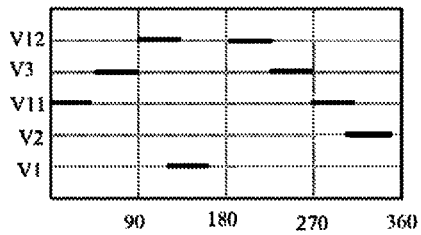
Fig. 23 Valve timing for Fig. 16

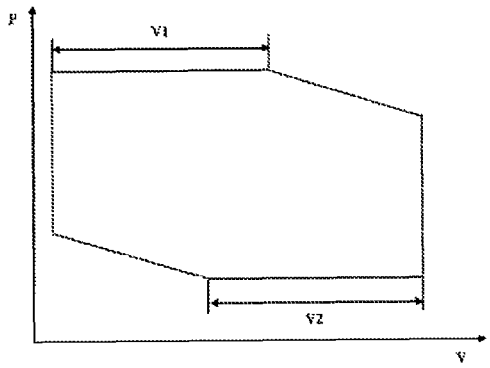
Fig. 24 P-V Diagram for Conventional G-M refrigerator
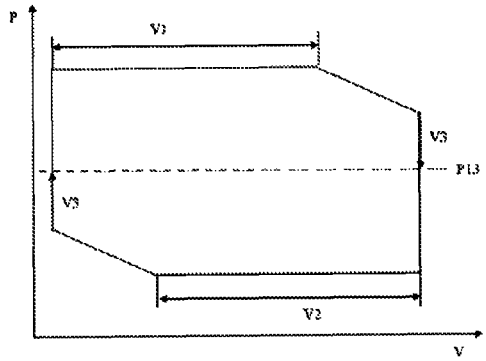
Fig. 25a P-V Diagram for 1 power reduction buffer connected to regenerator
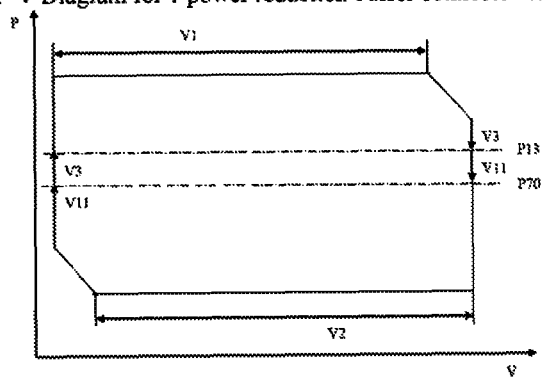
Fig. 25b P-V Diagram for 2 power reduction buffers connected to regenerator

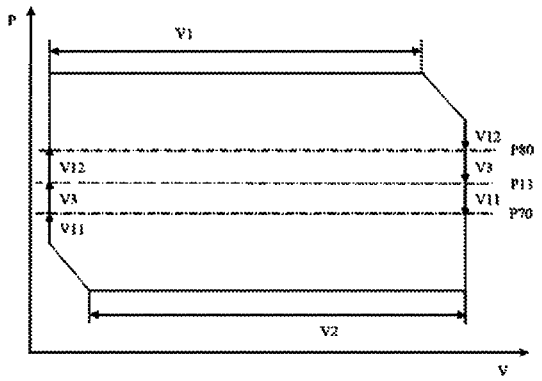
Fig. 25c P-V Diagram for 3 power reduction buffers connected to regenerator
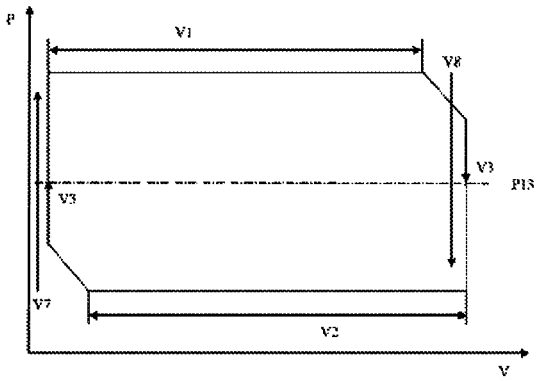
Fig. 26a P-V Diagram for Fig. 13
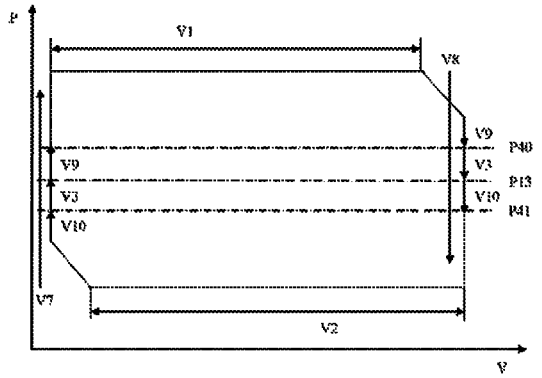
Fig. 26b P-V Diagram for Fig. 14

REDUCED INPUT POWER CRYOGENIC REFRIGERATOR

BACKGROUND OF THE INVENTION

The present invention relates to valved cryogenic refrigerators, in particular, Gifford McMahon (GM) refrigerators, and GM type pulse tube refrigerators. Gas is cycled between high and low pressures by a valve mechanism that connects to an expander. The valve mechanism commonly consists of a rotary valve disc and a valve seat. Rotary disc valves lend themselves to being designed with multiple ports. There are discrete ports, which, by periodic alignment of the different ports, allow the passage of a working fluid, supplied by a compressor, to and from the regenerators and working volumes of the expander.

GM and Solvay type refrigerators use compressors that supply gas at a nearly constant high pressure and receive gas at a nearly constant low pressure. The gas is supplied to a reciprocating expander that runs at a low speed relative to the compressor by virtue of the valve mechanism that alternately lets gas in and out of the expander.

W. E. Gifford also conceived of an expander that replaced the solid displacer with a gas displacer and called it a "pulse tube" refrigerator. This was first described in U.S. Pat. No. 3,237,421 which shows a pulse tube connected to valves like the earlier GM refrigerators.

Early pulse tube refrigerators were not efficient enough to compete with GM type refrigerators. A significant improvement was made by Mikulin et al., as reported in 1984, and increased interest ensued in searching for further improvements. Descriptions of major improvements since 1984 can be found in the references listed herein. All of these pulse tubes can run as GM type expanders that use valves to cycle gas in and out of the pulse tube. GM type pulse tubes running at low speed are typically used for applications below about 20 K.

This type of valved cryogenic refrigerator has the disadvantage of low efficiency due to the pressurization and depressurization of the void volumes in the expander as gas cycles in and out of the expander. In a valved cryogenic refrigerator, there is a large pressure difference through the high pressure valve right after it opens, because the pressure at the inlet of the regenerator is near the low pressure. On the other hand, when the low pressure valve opens, there is also a large pressure difference through the valve, because the pressure at the inlet of the regenerator is near the high pressure. This process generates an irreversible loss which cannot be decreased by enlarging the opening area of the valves. The loss pertains to the void volume of the cold head.

In Japanese patent P2001-317827 to Fujimoto, two buffers are connected to the inlet of the regenerator by two rotary valves controlled by a timing sequence as shown in FIG. 2 of P2001-317827. In this patent, during charging process, in the first step, gas first flows into the regenerator from the first buffer. In the second step, gas flows from the supply side of compressor into both the regenerator and the first buffer. The effect of the extra first buffer shown in this patent is small since the amount of gas which flows into the regenerator from the first buffer in the first step has to be compensated from the compressor in the second step. During discharging process, in the third step, gas flows out of the regenerator into the second buffer. In the fourth step, gas flows from both the regenerator and the second buffer to the return side of compressor. The effect of the extra second buffer shown in this patent is small since the gas which flows into the second buffer from the regenerator in the third step has to flow out of the second buffer into the compressor in the fourth step.

It is an object of this invention to reduce the amount of gas supplied by the compressor and to provide a cryogenic refrigerator with reduced pressure drop during gas cycling.

SUMMARY OF THE INVENTION

It has been found that a valved cryogenic refrigerator can be designed, such that part of the gas flow between the compressor and the expander can be supplied from and discharged to a valved connection to a buffer volume. The pressure drop loss through the valve is reduced with the invented concept and the amount of gas that needs to be supplied by the compressor is reduced.

This invention provides a means of reducing the power input to a GM or GM type pulse tube refrigerator. A buffer volume stores gas that flows to and from the warm end of the regenerator through a valve that opens and closes during the periods when the main supply and return valves are closed and is closed when the main supply and return valves are open. During the charging process, gas is charged into the regenerator from one or more buffer volumes instead of the supply side of the compressor when pressure at the inlet of the regenerator is lower than the pressure in the buffer. During the discharging process, gas is discharged from the regenerator to the buffer instead of the return side of the compressor when pressure at the inlet of the regenerator is higher than the pressure in the buffer. The net effect is to reduce the amount of gas that is supplied by the compressor thus increasing the system efficiency. In addition, the pressure difference through the valves may be reduced, the gas flow velocity may be lower, and the audible noise may be reduced as the gas flow velocity is reduced.

The buffer volume can be a separate volume or a buffer volume that is included in the expander to drive the GM displacer or the gas piston in a pulse tube.

The buffer volume can be a container with any kind of shape. It can be simply a long pipe or a flexible gas line.

The buffer volume can be a part of the compressor, valve unit, expander or any subsystems in a cooling system. It can also be either separated from or integrated with the compressor, valve unit, expander or any subsystem in a cooling system. It can be an internal volume inside the compressor, valve unit, expander or any subsystem in a cooling system.

This invention can be carried out by a single stage refrigerator, or a multi-stage refrigerator.

BRIEF DESCRIPTION OF THE DRAWINGS

FIG. 17 is an example of the valve timing sequence which can be applied to the refrigerators shown in FIG. 1 to FIG. 7.

FIG. 18 is an example of the valve timing sequence which can be applied to the refrigerators shown in FIG. 8 to FIG. 10.

FIG. 19 is an example of the valve timing sequence which can be applied to the refrigerators shown in FIG. 11 to FIG. 12.

FIG. 20 is an example of the valve timing sequence which can be applied to the refrigerator shown in FIG. 13.

FIG. 21 is an example of the valve timing sequence which can be applied to the refrigerator shown in FIG. 14.

FIG. 22 is an example of the valve timing sequence which can be applied to the refrigerator shown in FIG. 15.

FIG. 23 is an example of the valve timing sequence which can be applied to the refrigerator shown in FIG. 16.

FIG. 24 is a Pressure-Volume (P-V) diagram for a conventional G-M cycle refrigerator.

FIGS. 25*a*, 25*b*, and 25*c* are P-V diagrams for a G-M cycle refrigerator with one, two, and three buffer volumes respectively per the present invention.

FIGS. 26*a*, and 26*b* are P-V diagrams for G-M type active buffer pulse tubes as shown in FIGS. 13 and 14 respectively.

DETAILED DESCRIPTION OF THE INVENTION

The present invention is applicable to any kind of refrigerator in which gas is cycled in and out of the expander by a valve unit, including G-M refrigerators, Solvay refrigerators, and G-M type pulse tube refrigerators. It is of particular value when applied to low temperature pulse tubes that have multi-stages.

Figure 1:
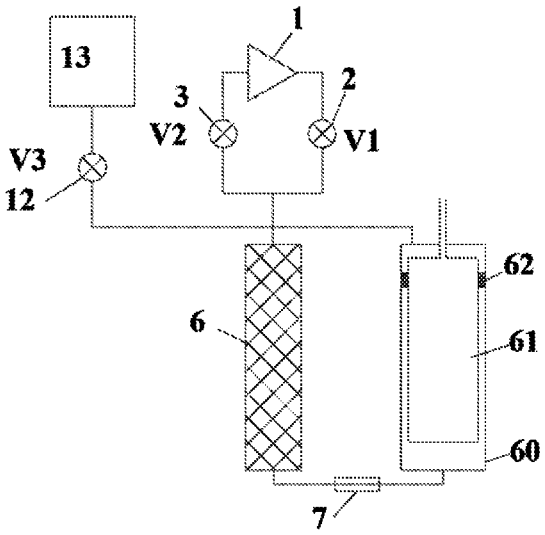
FIG. 1 is a schematic of a G-M refrigerator with a mechanical displacer drive in accordance with the present invention, in which small schematics show the component relations of the compressor, a buffer volume and three on-off valves.

FIG. 1 is a schematic of a G-M refrigerator with a mechanical displacer drive along with small schematics of a compressor 1 a buffer volume 13 and three on-off valves. The three on-off valves cycle gas in and out of regenerator 6. Valve 2, V1, controls gas flowing between the supply side of compressor 1 and the inlet of regenerator 6. Valve 3, V2, controls gas flowing between the inlet of regenerator 6 and the return side of the compressor. Valve 12, V3, controls gas flowing between the inlet of regenerator 6 and power reduction buffer volume 13. V1, V2 and V3 open and close according to the timing sequence as shown in FIG. 17. A displacer 61 is enclosed in a cylinder 60. A controller which is not shown in FIG. 1 controls the valve timing and the displacement of displacer 61. A seal 62, placed between cylinder 60 and displacer 61, prevents cold gas from mixing with warm gas. A heat exchanger 7 exchanges heat between the refrigerator and the load.

At the beginning of the charging process, the inlet of regenerator 6 is at low pressure, Pl. Gas then enters regenerator 6 from buffer volume 13, which is at a medium pressure, Pm when valve V3, is opened. After the pressure at the inlet of regenerator 6 is almost equal to Pm, V3 is closed and valve V1, is opened. Gas flows into the inlet of regenerator 6 from the supply side of compressor 1, which is at high pressure, Ph. Displacer 61, which is at the cold end of cylinder 60 at the beginning of the charging process, then moves to the warm end while the displaced volume at the cold end fills with gas at Ph.

At the beginning of the discharging process, the inlet of regenerator 6 is at Ph, gas flows out of regenerator 6 to buffer volume 13 while V3 is open. After the pressure at the inlet of regenerator 6 nearly reaches the pressure in the buffer volume 13, V3 is closed and valve V2 is opened. Gas flows out of the inlet of regenerator 6 to the return side of compressor 1, which is at a low pressure, Pl. Displacer 61 which is at the warm end of cylinder 60 then moves to the cold end while the displaced volume at the cold end returns gas at Pl to compressor 1. In a conventional G-M refrigerator all of the gas flows into regenerator 6 from compressor 1 during charging and all of the gas flows out of regenerator 6 to compressor 1 during discharging. Compared to a conventional G-M refrigerator, the G-M refrigerator in accordance with this invention has lower input power since there is less gas flowing from the compressor. Buffer volume 13 and V3 can be thought of as power reduction components. There may also be less pressure drop loss through V1 and V2 since less gas flows through these valves.

Figure 2:
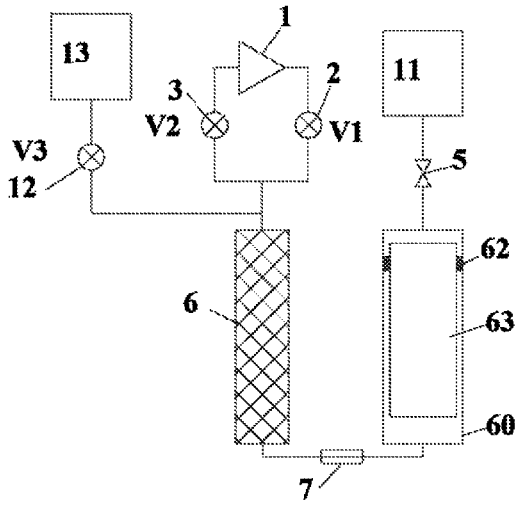
FIG. 2 is a schematic of a G-M refrigerator with a pneumatic displacer drive in accordance with the present invention, in which small schematics show the component relations of the compressor, two buffer volumes and three on-off valves.

FIG. 2 is a schematic of a G-M refrigerator with a pneumatic displacer drive. With a pneumatic displacer drive, the phase shift of displacer 63 is achieved by gas flow from a displacer driver buffer volume 11 through a flow restrictor 5. The flow restrictor 5 could be an orifice, a needle valve, a capillary tube or any other similar art. The phrase "phase shift" refers to the cycling of the displacer being out of phase with the pressure cycling so that the pressure is near its maximum and minimum values when the displacer is moving.

The working process of a G-M refrigerator with a pneumatic drive and power reduction buffer volume 13 and V3 is similar to a unit with a mechanical drive as described in connection with FIG. 1.

Figure 3:
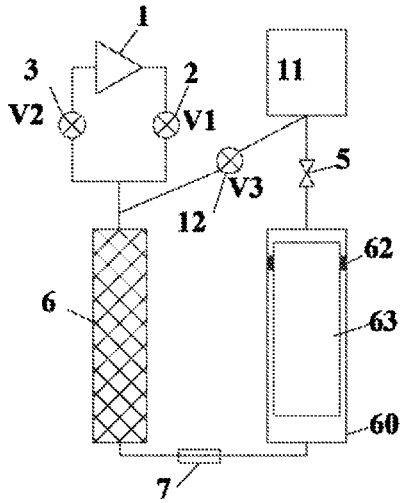
FIG. 3 is a schematic of a G-M refrigerator with a pneumatic displacer drive in accordance with the present invention, in which small schematics show the component relations of the compressor, a single buffer volume and three on-off valves.

FIG. 3 is a schematic of a G-M refrigerator with a pneumatic displacer drive in accordance with this invention in which the power reduction buffer volume 13 of FIG. 2 is combined with displacer driver buffer volume 11. This is possible because they both have approximately the same pressure, Pm. Valve V3 connects buffer volume 11 to the warm end of regenerator 6. The working process is the same as described in connection with FIG. 1.

Figure 4:
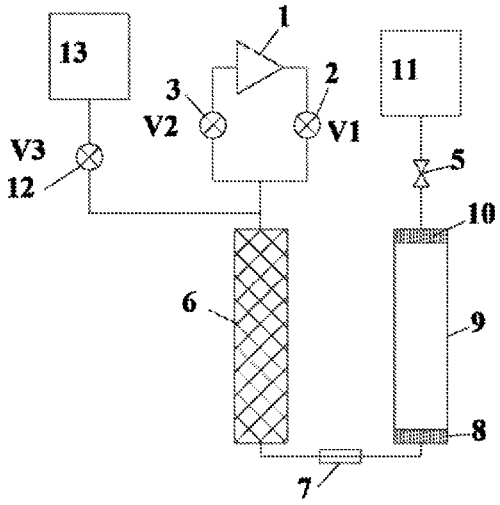
FIG. 4 is a schematic of a G-M type single orifice pulse tube refrigerator in accordance with the present invention in which small schematics show the component relations of the compressor, two buffer volumes and three on-off valves.

FIG. 4 is a schematic of a G-M type single orifice pulse tube refrigerator in accordance with this invention. An orifice pulse tube refrigerator is similar to a G-M refrigerator with a pneumatic displacer drive, except that, in a pulse tube refrigerator, there is no solid displacer. The solid displacer 63 in FIG. 2 is replaced by a gas displacer in pulse tube 9 with a warm end flow smoother 10 and a cold end flow smoother 8 in FIG. 4. A means of controlling the reciprocation of the gas displacer, referred to as a phase shifter, includes buffer volume 11 and flow restrictor 5. These contribute to the phase shift between the gas flow velocity of the gas displacer and the pressure oscillation in the pulse tube. This is analogous to the description of the process for FIG. 1 in which the pressure approximately reaches Ph then the displacer moves up, followed by the pressure approximately dropping to Pl then the displacer moves down. Buffer volume 11 and orifice 5 serve the same function of driving the gas displacer as they do for the solid displacer in FIG. 2. The working process is the same as described in connection with FIG. 1.

Figure 5:
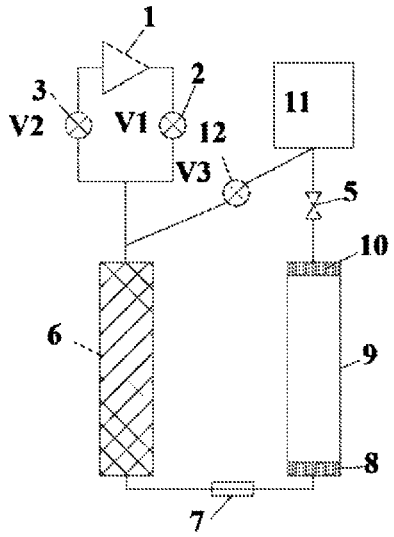
FIG. 5 is a schematic of a G-M type single orifice pulse tube refrigerator in accordance with the present invention in which small schematics show the component relations of the compressor, a single buffer volume and three on-off valves.

FIG. 5 is a schematic of a G-M type single orifice pulse tube refrigerator in accordance with this invention, in which the power reduction buffer volume of FIG. 4 is combined with gas displacer driver buffer volume 11. The inlet of regenerator 6 is connected to buffer volume 11 through valve V3. The working process is the same as described in connection with FIG. 1.

Figure 6:
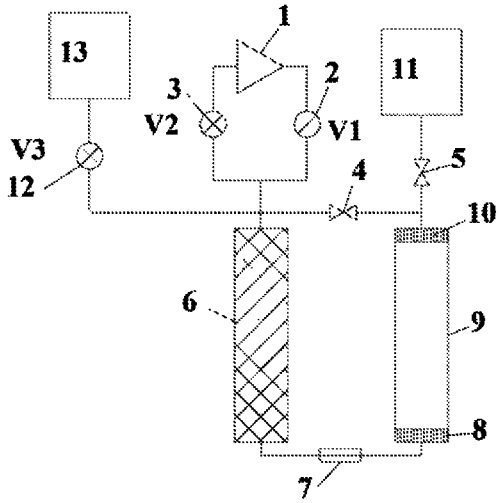
FIG. 6 is a schematic of a G-M type double inlet pulse tube refrigerator in accordance with the present invention in which small schematics show the component relations of the compressor, two buffer volumes and three on-off valves.

FIG. 6 is a schematic of a G-M type double inlet pulse tube refrigerator in accordance with this invention. A double inlet pulse tube refrigerator is similar to a single orifice pulse tube refrigerator, except that, in a double inlet pulse tube refrigerator, there is a flow passage connecting the warm end of regenerator 6 to the warm end of pulse tube 9. A flow restrictor 4 controls gas flowing through this passage. By having an appropriate amount of gas flowing through this passage, the phase shift in pulse tube 9 is improved relative to the single orifice pulse tube of FIG. 4. Also, the amount of gas flowing through regenerator 6 to pulse tube 9 is reduced, therefore, the efficiency of the regenerator is improved. Buffer volume 13 and valve V3 serve the same function as described in FIG. 4. The working process is the same as described in connection with FIG. 1.

Figure 7:
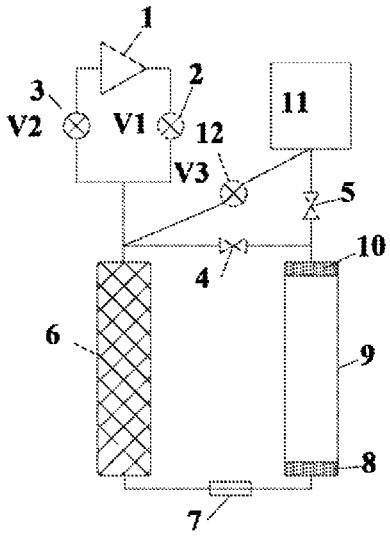
FIG. 7 is a schematic of a G-M type double inlet pulse tube refrigerator in accordance with the present invention in which small schematics show the component relations of the compressor, a single buffer volume and three on-off valves.

FIG. 7 is a schematic of a G-M type double inlet pulse tube refrigerator in accordance with this invention, in which the power reduction buffer volume of FIG. 6 is combined with gas displacer driver buffer volume 11. The inlet of regenerator 6 is connected to buffer volume 11 through valve V3. The working process is the same as described in connection with FIG. 1. An example of the valve timing for V1, V2 and V3, which can be applied to the refrigerators in FIG. 1 to FIG. 7 is shown in FIG. 17. It should be pointed out that the timing shown in FIG. 17 is only used to explain the basic mechanism of these refrigerators. The actual valve timing could be varied from the timing shown in FIG. 17.

Figure 8:
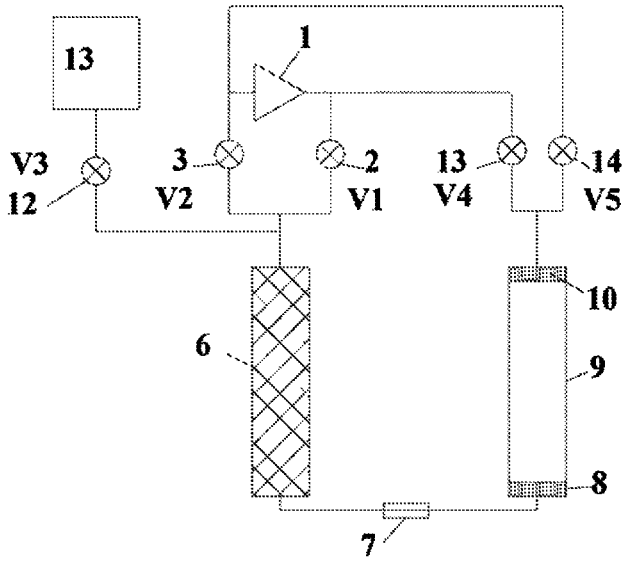
FIG. 8 is a schematic of a G-M type basic four-valve pulse tube refrigerator in accordance with the present invention in which small schematics show the component relations of the compressor, a buffer volume and five on-off valves.

FIG. 8 is a schematic of a basic four-valve pulse tube refrigerator to which power reduction buffer volume 13 and valve V3 have been added in accordance with this invention. The phase shift of the gas displacer in pulse tube 9 is achieved by properly controlling the valve timing of V1, V2, V3, V4 and V5. Four-valve pulse tube refrigerators have an advantage that the phase shift in pulse tube 9 is controlled by active valves 13, V4, and 14, V5, instead of passive valves as shown in FIG. 4 to FIG. 7. The working process is the same as described in connection with FIG. 1.

Figure 9:
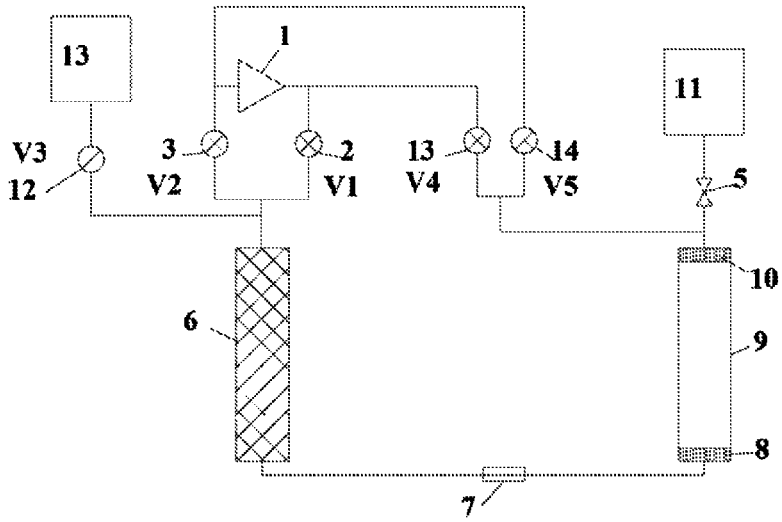
FIG. 9 is a schematic of a G-M type four-valve orifice pulse tube refrigerator in accordance with the present invention in which small schematics show the component relations of the compressor, two buffer volumes and five on-off valves.

FIG. 9 is a schematic of a four-valve orifice pulse tube refrigerator to which power reduction buffer volume 13 and valve V3 have been added in accordance with this invention. A four-valve orifice pulse tube refrigerator is similar to that of a basic four-valve pulse tube refrigerator as shown in FIG. 8, except that, flow restrictor 5 and buffer volume 11 are added to the warm end of pulse tube 9 in FIG. 9. The phase shift in pulse tube 9 is achieved by properly controlling the valve timing of V1, V2, V3, V4 and V5, and the flow to and from buffer volume 11 through flow restrictor 5. Compared to a basic four-valve pulse tube refrigerator as shown in FIG. 8, the performance of a four-valve orifice pulse tube refrigerator is improved by having some gas exchanged between buffer volume 11 and pulse tube 9 instead of to and from compressor 1. The working process is the same as described in connection with FIG. 1. The overall efficiency of the refrigerator is improved by reducing the gas flow from the compressor, therefore, reducing the input power of the compressor.

Figure 10:
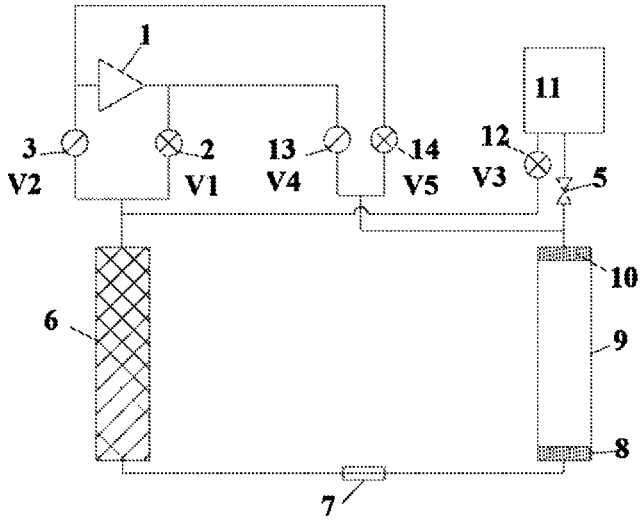
FIG. 10 is a schematic of a G-M type four-valve orifice pulse tube refrigerator in accordance with the present invention in which small schematics show the component relations of the compressor, a single buffer volume and five on-off valves.

FIG. 10 is a schematic of a four-valve orifice pulse tube refrigerator in accordance with this invention, in which the power reduction buffer volume of FIG. 9 is combined with gas displacer driver buffer volume 11. The inlet of regenerator 6 is connected to buffer volume 11 through valve V3. The working process is the same as described in connection with FIG. 1. An example of the valve timing for V1, V2, V3, V4 and V5 of the four-valve pulse tube refrigerators in FIG. 8 to FIG. 10 is shown in FIG. 18.

Figure 11:
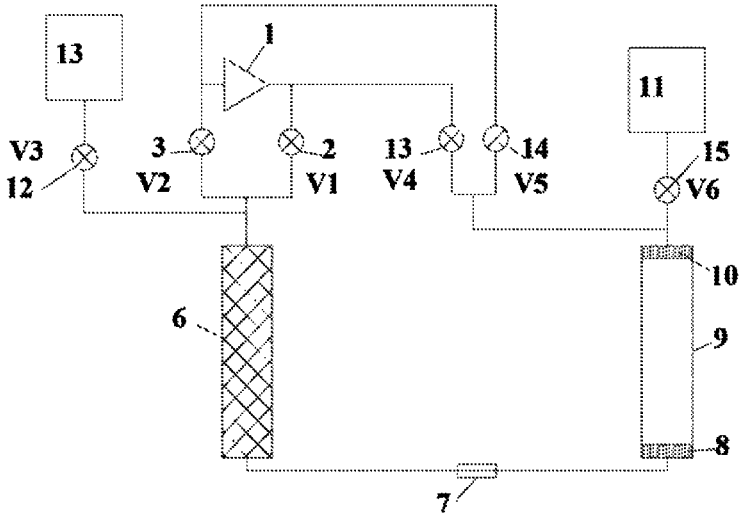
FIG. 11 is a schematic of a G-M type five-valve pulse tube refrigerator in accordance with the present invention in which small schematics show the component relations of the compressor, two buffer volumes and six on-off valves.

FIG. 11 is a schematic of a five-valve pulse tube refrigerator to which power reduction buffer volume 13 and valve V3 have been added in accordance with this invention. A five-valve pulse tube refrigerator is similar to the four-valve orifice pulse tube refrigerator of FIG. 9, except that, in a five-valve pulse tube refrigerator, flow restrictor 5 in FIG. 9 is replaced by active valve 15, V6. The phase shift in the FIG. 11 pulse tube is achieved by properly controlling the valve timing of V1, V2, V3, V4, V5 and V6. In a five-valve pulse tube refrigerator, the phase shift can by controlled more precisely relative to the FIG. 9 pulse tube by controlling the gas flow between buffer volume 11 and pulse tube 9 by an active valve 15 instead of a passive flow restrictor 5. The working process is the same as described in connection with FIG. 1.

Figure 12:
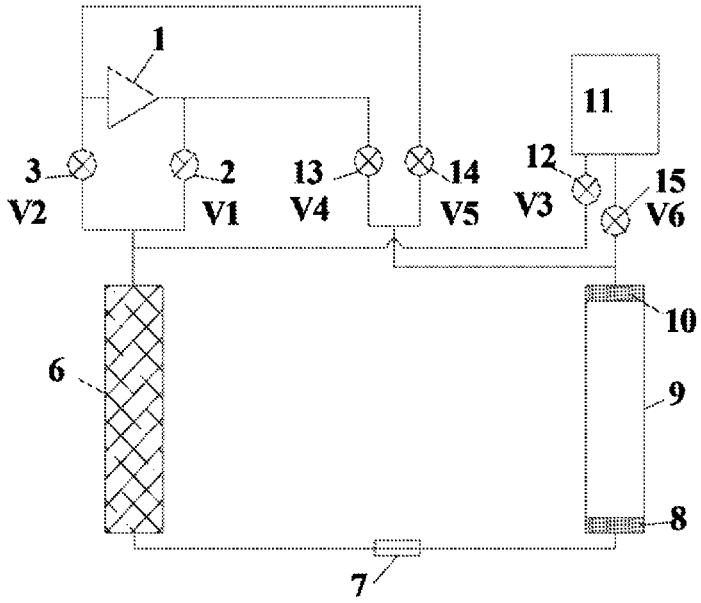
FIG. 12 is a schematic of a G-M type five-valve pulse tube refrigerator in accordance with the present invention in which small schematics show the component relations of the compressor, a single buffer volume and six on-off valves.

FIG. 12 is a schematic of a five-valve pulse tube refrigerator in accordance with this invention, in which the power reduction buffer volume of FIG. 11 is combined with gas displacer driver buffer volume 11. The inlet of regenerator 6 is connected to buffer volume 11 through valve V3. The working process is the same as described in connection with FIG. 1.

An example of the valve timing for V1, V2, V3, V4, V5 and V6 of the five-valve pulse tube refrigerators in FIG. 11 and FIG. 12 is shown in FIG. 19.

Figure 13:
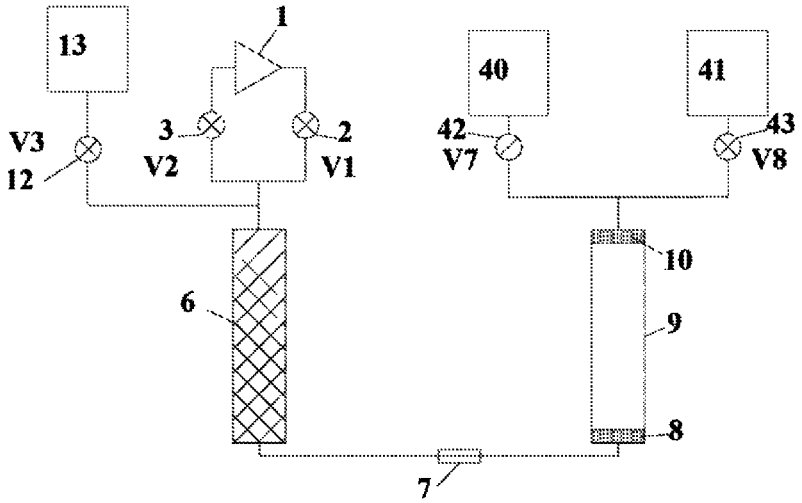
FIG. 13 is a schematic of a G-M type active-buffer pulse tube refrigerator in accordance with the present invention in which small schematics show the component relations of the compressor, three buffer volumes and five on-off valves.

FIG. 13 is a schematic of an active-buffer pulse tube refrigerator to which power reduction buffer volume 13 and valve V3 have been added in accordance with this invention. An active-buffer pulse tube refrigerator has no connection between compressor 1 and the warm end of pulse tube 9. Gas cycles between the warm end of pulse tube 9 and two buffers, buffer volume 40 which has a pressure near Ph, and 41 which has a pressure near Pl, through two active valves, valve 42, V7 and valve 43, V8. The phase shift in pulse tube 9 is achieved by properly controlling the valve timing of V1, V2, V3, V7 and V8. The performance of an active-buffer pulse tube refrigerator is improved by having gas cycle between buffer volume 13 and the warm end of regenerator 6. The overall efficiency of the refrigerator is improved by reducing the gas flow from the compressor, therefore, reducing the input power of the compressor. An example of the valve timing for V1, V2, V3, V7 and V8 of the active-buffer pulse tube refrigerator in FIG. 13 is shown in FIG. 20.

Figure 14:
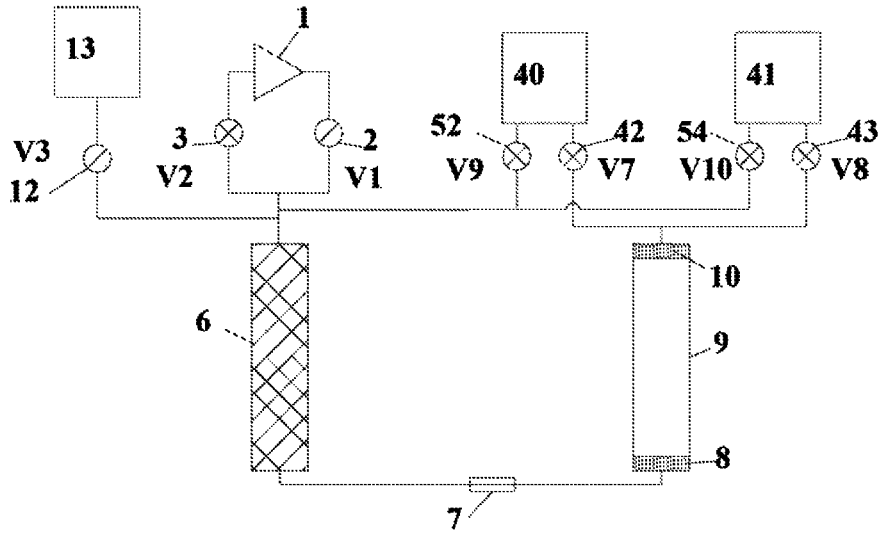
FIG. 14 is a schematic of a G-M type active-buffer pulse tube refrigerator in accordance with the present invention in which small schematics show the component relations of the compressor, three buffer volumes and seven on-off valves.

FIG. 14 is a schematic of an active-buffer pulse tube refrigerator in accordance with this invention. It is similar to that of the pulse tube refrigerator in FIG. 13, except that, the inlet of the regenerator is connected to buffer volumes 40 and 41 through valves 52, V9, and 54, V10. V7 and V8 in FIG. 14 are similar to V7 and V8 in FIG. 13 except the valve timing is slightly different. An example of the valve timing for V1, V2, V3, V7, V8, V9, and V10 of the active-buffer pulse tube refrigerator in FIG. 14 is shown in FIG. 21.

Figure 15:
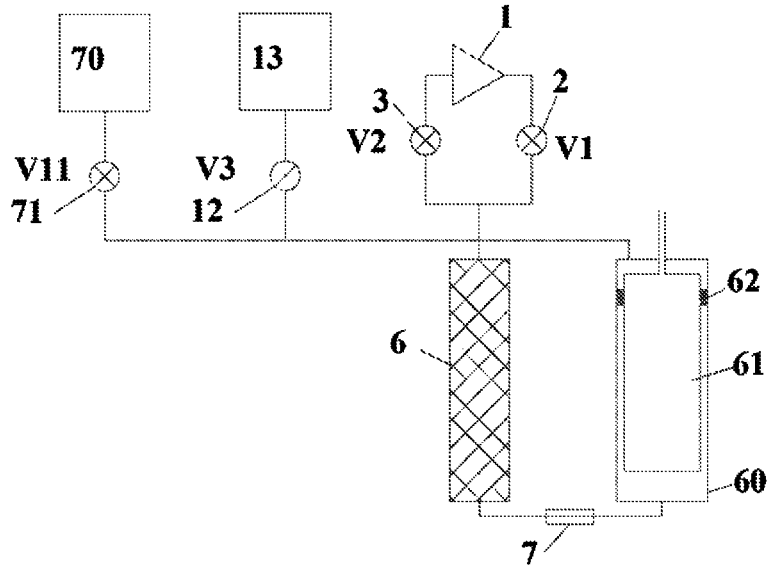
FIG. 15 is a schematic of a G-M refrigerator in accordance with the present invention in which small schematics show the component relations of the compressor, two buffer volumes and four on-off valves. Gas is supplied from two buffer volumes in sequence before being supplied from the compressor.

Although in FIG. 1 to FIG. 13, only one power reduction buffer volume 13 or 11 and valve V3 are connected to the inlet of regenerator 6, it should be realized that a series of buffers with control valves could be connected to the inlet of the regenerator to further reduce the power input to the compressor. The principal of using additional power reduction buffer volumes and control valves is illustrated using the G-M refrigerators shown in FIG. 15 and FIG. 16. These are two variations of the G-M refrigerator shown in FIG. 1. In FIG. 15, two buffer volumes, 13 and 70, are connected to the inlet of regenerator 6 through two valves, V3 and 71, V11, which are controlled according to the valve timing shown in FIG. 22.

Figure 16:
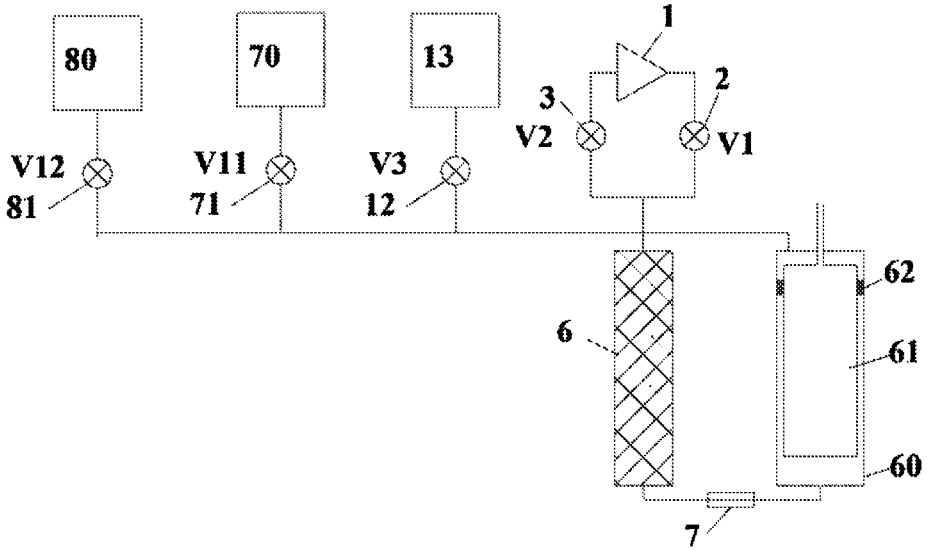
FIG. 16 is a schematic of a G-M refrigerator in accordance with the present invention in which small schematics show the component relations of the compressor, three buffer volumes and five on-off valves. Gas is supplied from three buffer volumes in sequence before being supplied from the compressor.

In FIG. 16, three power reduction buffer volumes, 13, 70 and 80, are connected to regenerator 6 through three valves, V3, V11 and 81, V12, which are controlled according to the valve timing shown in FIG. 23.

FIG. 24 is a Pressure-Volume (P-V) diagram for a typical G-M cycle refrigerator that shows the relation between the pressure in the cold displaced volume 60, or its equivalent in a pulse tube, and displacement of 60. In the original cycle description as found in U.S. Pat. No. 2,906,101 the P-V diagram is rectangular but in practice it has been found to be more efficient to close valves V1 and V2 before the solid or gas displacer reach the ends of the stroke. The cycle proceeds in a clockwise direction. The amount of refrigeration that is produced each cycle is proportional to the area of the diagram. V1 admits gas from the compressor at high pressure and V2 vents gas to the compressor at low pressure. By having V1 and V2 close before the end of the stroke there is some expansion of the high pressure gas and some recompression of the low pressure gas due to the transfer of gas within the expander.

FIG. 25*a* is a P-V diagram for refrigerators shown in FIGS. 1 to 12 with one power reduction buffer volume and valve V3 per the present invention. With reference to the timing diagram shown in FIG. 17 the P-V diagram of FIG. 24 is modified by having some gas at the end of the high pressure expansion phase flow to the buffer volume when V3 is opened, and similarly at the end of the low pressure recompression phase gas flows from the buffer volume when V3 is opened. It is important to note that none of the gas that flows to and from the power reduction buffer volume through valve V3 is supplied or returned to the compressor. Because some of the gas that pressurizes the expander comes from the buffer and is returned to the buffer more refrigeration can be produced with the same amount of gas supplied by the compressor. Alternately the same amount of refrigeration can be produced and a smaller compressor can be used. This reduces the input power to the cryorefrigerator.

FIG. 26*b* is a P-V diagram for refrigerators with two power reduction buffer volumes and valves per the present invention. The arrangement with two power reduction buffer volumes and valves is illustrated in FIG. 15 as an adaptation of FIG. 1 but the second power reduction buffer volume 70 and valve V11 can be added to all of the refrigerators shown in FIGS. 2 to 12. With reference to the valve timing chart shown in FIG. 22, the P-V diagram of FIG. 24 is modified by having some gas at the end of the high pressure expansion phase flow to the buffer volumes when V3, and V1, are opened and closed sequentially, and similarly at the end of the low pressure recompression phase gas flows from the buffer volumes when V11, and V3 are opened and closed sequentially. The addition of a second power reduction buffer volume and valve further reduce the amount of gas that has to be supplied by the compressor relative to a single power reduction buffer volume and valve.

FIG. 26*c* is a P-V diagram for refrigerators with three power reduction buffer volumes and valves per the present invention. The arrangement with three power reduction buffer volumes and valves is illustrated in FIG. 16 as an adaptation of FIG. 1 but the second and third power reduction buffer volumes, 70 and 80, and valves, V11 and V12, can be added to all of the refrigerators shown in FIGS. 2 to 12. With reference to the valve timing chart shown in FIG. 23, the P-V diagram of FIG. 24 is modified by having some gas at the end of the high pressure expansion phase flow to the buffer volumes when V11, V3, and V12, are opened and closed sequentially, and similarly at the end of the low pressure recompression phase gas flows from the buffer volumes when V12, V3, and V11 are opened and closed sequentially. The addition of a third power reduction buffer volume and valve further reduce the amount of gas that has to be supplied by the compressor relative to two power reduction buffer volumes and valves.

FIG. 26*a* is a P-V diagram for the refrigerator shown in FIG. 13 with one power reduction buffer volume and valve per the present invention. With reference to the timing chart shown in FIG. 20, the P-V diagram of FIG. 24 is modified by having some gas during the compression phase flow from power reduction buffer volume 13 when V3 is opened and closed, and similarly during the expansion phase gas flows to power reduction buffer volume 13 when V3 is opened and closed. None of the gas that flows to and from buffer volume 13 is supplied or returned to the compressor. Because a significant fraction of the gas that pressurizes the expander comes from buffer volume 13 and is returned to buffer volume 13, less gas is required to produce a given amount of refrigeration so the input power can be reduced.

FIG. 26*b* is a P-V diagram for the refrigerator shown in FIG. 14 with one power reduction buffer volume 13 and valve V3 combined with the use of driver buffer volumes 40 and 41 as power reduction buffer volumes by connecting them through valves V9 and V10, to the warm end of regenerator 6. With reference to the timing chart shown in FIG. 21, the P-V diagram of FIG. 24 is modified by having some gas during the compression phase flow from buffer volumes 41, 13, and 40, when V10, V3, and V9 are opened and closed sequentially. Similarly during the expansion phase gas flows from buffer volumes 40, 13, and 41, when V9, V3, and V10 are opened and closed sequentially. This results in a further reduction in gas that is required to produce a given amount of refrigeration, thus the input power can be further reduced.

Although the refrigerators shown in FIG. 1 to FIG. 16 are single stage refrigerators, it is also possible to apply the concept of this invention to a multi-stage refrigerator with multiple valves by properly controlling the timing of the valves.

The foregoing describes the invention in terms of embodiments foreseen by the inventor for which an enabling description was available, notwithstanding that insubstantial modifications of the invention, not presently foreseen, may nonetheless represent equivalents thereto.

The invention claimed is:

1. A cryorefrigerator comprising:

a compressor for supplying a pressurized gas, the compressor comprising a return side and a supply side;

a regenerator comprising a regenerator warm end and a regenerator cold end;

an expander comprising an expander warm end and an expander cold end, the expander cold end operatively connected to the regenerator;

a buffer volume;

a valve unit consisting of a single buffer control valve placing the buffer volume in fluid communication with the regenerator warm end and the expander warm end without any other intervening valves between the buffer volume and the regenerator and the expander;

a first valve placing the supply side of the compressor in fluid communication with the regenerator warm end and the expander warm end without any other intervening valves between the supply side of the compressor and the regenerator and the expander; and a second valve placing the return side of the compressor in fluid communication with the regenerator warm end and the expander warm end without any other intervening valves between the return side of the compressor and the regenerator and the expander; and a controller configured to open and close the valves in sequence so that:

the buffer control valve opens and closes, then the first valve opens and closes, then the buffer valve opens and closes, and then the second valve opens and closes.

2. The cryorefrigerator of claim 1, wherein the expander is a reciprocating expander.

3. The cryorefrigerator of claim 1, further comprising a heat exchanger disposed operatively between the regenerator cold end and the expander cold end.

4. A cryorefrigerator comprising:

a compressor for supplying a pressurized gas, the compressor comprising a return side and a supply side;

a regenerator comprising a warm end and a cold end;

an expander operatively connected to the cold end;

a buffer volume; and a valve unit consisting of a single first control valve placing the buffer volume in fluid communication with the warm end of the regenerator without any other intervening valves between the buffer volume and the warm end of the regenerator, the first control valve being a buffer control valve, a second control valve placing the supply side of the compressor in fluid communication with the warm end of the regenerator without any other intervening valve between the supply side of the compressor and the warm end of the regenerator, and a third control valve placing the warm end of the regenerator in fluid communication with the return side of the compressor without any other intervening valves between the return side of the compressor and the regenerator; and a controller configured to open and close the control valves in sequence so that:

the first control valve opens and closes, then the second control valve opens and closes, then the first control valve opens and closes, and then the third control valve opens and closes.

5. The cryorefrigerator of claim 4, wherein the expander is a pulse tube having a pulse tube buffer volume connected through an orifice to a warm end of the pulse tube.

6. The cryorefrigerator of claim 5, wherein the buffer volume is a pulse tube buffer volume.

7. The cryorefrigerator of claim 4, further comprising a heat exchanger disposed operatively between the cold end of the regenerator and the expander.

8. A cryorefrigerator comprising:

a compressor for supplying a pressurized gas, the compressor comprising a return side and a supply side;

a regenerator comprising a warm end and a cold end;

an expander operatively connected to the cold end of the regenerator;

a buffer volume; and a valve unit comprising a single first control valve in a first line that provides fluid communication between the buffer volume and the warm end of the regenerator, the first control valve being a buffer control valve, a second control valve in a second line that provides fluid communication between the supply side of the compressor and the warm end of the regenerator, and a third control valve in a third line that provides fluid communication between the warm end of the regenerator and the return side of the compressor;

a controller configured to open and close the control values in a sequence wherein first, the first control valve being operative to allow the pressurized gas to flow from the buffer volume to the regenerator, second, the second control valve being operative to allow the pressurized gas to flow from the compressor to the regenerator, third, the first control valve being operative to allow the pressurized gas to flow from the regenerator to the buffer volume, fourth, the third control valve being operative to allow the pressurized gas to flow from the regenerator to the compressor, and wherein no two valves are open at the same time.

* * * * *